United States Patent [19]

Griffin

[11] Patent Number: 4,629,004

[45] Date of Patent: Dec. 16, 1986

[54] PLUNGER LIFT FOR CONTROLLING OIL AND GAS PRODUCTION

[76] Inventor: Billy W. Griffin, P.O. Box 31989, Aurora, Colo. 80041

[21] Appl. No.: 700,032

[22] Filed: Feb. 11, 1985

Related U.S. Application Data

[63] Continuation-in-part of Ser. No. 623,377, Jun. 22, 1984, abandoned.

[51] Int. Cl.[4] ..... F04B 47/12; E21B 43/00

[52] U.S. Cl. ..... 166/372; 166/170; 417/56; 417/58

[58] Field of Search ..... 166/369, 370, 68, 105, 166/105.2, 112, 177, 170, 372; 417/56–60

[56] References Cited

U.S. PATENT DOCUMENTS

| | | | |
|---|---|---|---|
| 1,922,396 | 2/1931 | Ricker | 103/52 |
| 2,417,349 | 4/1944 | Colbaugh | 103/202 |
| 2,508,174 | 5/1950 | Knox et al. | 417/57 |
| 2,878,754 | 3/1959 | McMurry | 417/60 |
| 2,970,547 | 2/1961 | McMurry | 417/57 |
| 3,147,808 | 9/1964 | McCarvell et al. | 166/170 X |
| 3,171,487 | 3/1965 | Ault | 166/170 X |
| 3,179,022 | 12/1965 | Bloudoff | 92/252 |
| 4,007,784 | 2/1977 | Watson et al. | 166/170 |
| 4,030,858 | 6/1977 | Coles, Jr. | 417/56 |
| 4,410,300 | 10/1983 | Yerian | 417/56 |
| 4,502,843 | 3/1985 | Martin | 417/56 |

*Primary Examiner*—Stephen J. Novosad
*Assistant Examiner*—David J. Bagnell
*Attorney, Agent, or Firm*—Sheridan, Ross and McIntosh

[57] ABSTRACT

A plunger lift is adapted to be disposed in a well tubing string for slidable movement in relation to the tubing string in response to lift pressure. The plunger lift is an integral, one-piece unit that comprises a generally cylindrical, elongated shaft having an external, spirally extending coil machined in fixed relation to the external surface of the shaft. The spiral coil is disposed on the shaft such that an oblique angle is formed by the coil and a line perpendicular to the shaft. The coil is defined by a radially and outwardly projecting web terminating in an outer rim which is directed downwardly in an axial direction away from the web to form an undercut or recessed portion beneath the web. The coil traverses the major length of the shaft for advancement of well fluids therealong. A choke passage is provided in the shaft so that fluid is able to pass upwardly through the plunger lift for the selective withdrawal of fluids from the upper end of the coil.

14 Claims, 10 Drawing Figures

PLUNGER LIFT FOR CONTROLLING OIL AND GAS PRODUCTION

CROSS-RELATED PATENT APPLICATION

This application is a continuation-in-part of my copending patent application having Ser. No. 06/623,377 and a filing date of June 22, 1984 now abandoned, and entitled "Plunger Lift for Controlling Oil and Gas Production."

This invention relates to artificial lift devices for oil and gas wells, and more particularly relates to a novel and improved plunger lift which is characterized in particular by its ability to operate effectively in low pressure wells.

BACKGROUND AND FIELD OF THE INVENTION

Various methods and techniques for enhancing the recovery of oil and gas from a producing well have been advanced over the years. One such approach is to employ a plunger lift which, as a method of artificial lift, utilizes the well's own energy to produce the reservoir fluids which the well normally cannot expel under natural flow and is typically employed in de-watering gas wells, enhancing recovery from high gas/oil ratio wells and for cutting paraffin. In a typical plunger lift installation, the plunger lift is installed in the production string and becomes an interface between the fluid and gases as it travels to the surface to expel fluid. The plunger movement is controlled by a cyclical operation which creates a differential across the plunger and normally is accomplished by opening and closing a valve under the control of a time cycle controller or other automatic pressure-actuated controller. Of course, the type of well, method of well completion and production facilities will determine the specific type of wellhead controls and equipment required for optimum production.

In order to minimize the possibility of jamming the plunger lift as it travels through the tubing string, it has been proposed in the past to provide a rotor or spinning element on a portion of the lift which rotates independently of the rest of the lift for the purpose of creating turbulence and increase the sealing effect between the lift and the walls of the tubing string so as to reduce the escape of gas around the lift. Representative of this approach is U.S. Pat. No. 4,007,784 to W. L. Watson et al. A similar approach is taken in U.S. Pat. No. 4,410,300 to H. W. Yerian in which slots at one end of the lift serve to deflect escaping gas streams and promote turbulence to improve the gas sealing capability as well as to minimize the risk of jamming. Typical of other approaches to the construction of plunger lift units are disclosed in U.S. Pat. Nos. 1,992,396 to N. H. Ricker; 2,417,349 to S. G. Colbaugh; 3,179,022 to P. S. Bloudoff; and 4,030,858 to O. C. Coles, Jr. However, to the best of my knowledge, all of these devices as well as others in commercial use have suffered definite limitations particularly in connection with their use in low pressure wells having a pressure as low as 60 psi. A principal reason is that spinning or rotational forces are not created along the substantial length of the lift and does not provide an effective means for the controlled leakage of fluid past or through the lift as it is caused to rise by virtue of the differential pressure in the tubing string.

SUMMARY OF THE INVENTION

In accordance with the present invention there has been devised a new and improved plunger lift which is adapted to be disposed in the tubing string of a well for slidable movement in the tubing string in response to lift pressure. The plunger lift is an integral, one-piece unit having a diameter almost equal to the diameter of the tubing string. The plunger lift comprises a generally cylindrical, elongated shaft and an external, continuous, spirally extending coil machined in fixed relation to the external surface of the shaft. A first flange or a seal is provided at the upper end of the shaft and a choke passage is formed in the shaft so that fluid is able to pass upwardly along the spiral coil and through the first flange. As a result, there is a selective withdrawal of fluids at the upper end of the plunger lift adjacent to the end of the spiral coil. The spiral coil itself may be formed using a number of different configurations. In one embodiment, the coil is defined by a web projecting radially and outwardly from the shaft and terminating in an outer rim or face, the rim being directed downwardly in an axial direction away from the web to form an undercut or recessed portion beneath the web, and the coil traverses the major length of the shaft for advancement of well fluids therealong. In another embodiment, the coil has an outer face that is formed with a groove or channel. Additionally, the thickness of the spiral coil varies, i.e. the spiral is thicker at the outer face than it is along those portions which are adjacent to the shaft.

It is therefore a principal object of the present invention to provide for a novel and improved plunger lift adapted for use in gas and oil recovery operations as well as for dewatering gas wells.

Another object of the present invention is to provide for a novel and improved plunger lift which is capable of working under low gas pressure conditions without danger of jamming in the well.

It is a further object of the present invention to provide for a novel and improved plunger lift installation in which a plunger lift member is capable of rising through the tubing string in response to low gas pressure levels and is capable of lifting heavier fluid loads than heretofore possible.

It is an additional object of the present invention to provide for a novel and improved plunger lift which employs a spinning action using a spiral coil in combination with a choke, is extremely durable and rugged in construction with high resistance to wear while avoiding entrapment of fluid along the surface of the plunger.

Other objects, advantages and features of the present invention will become more readily appreciated and understood when taken together with the following detailed description of a preferred embodiment in conjunction with the accompanying drawings, in which:

DETAILED DESCRIPTION OF THE PREFERRED EMBODIMENTS

Figure 1:
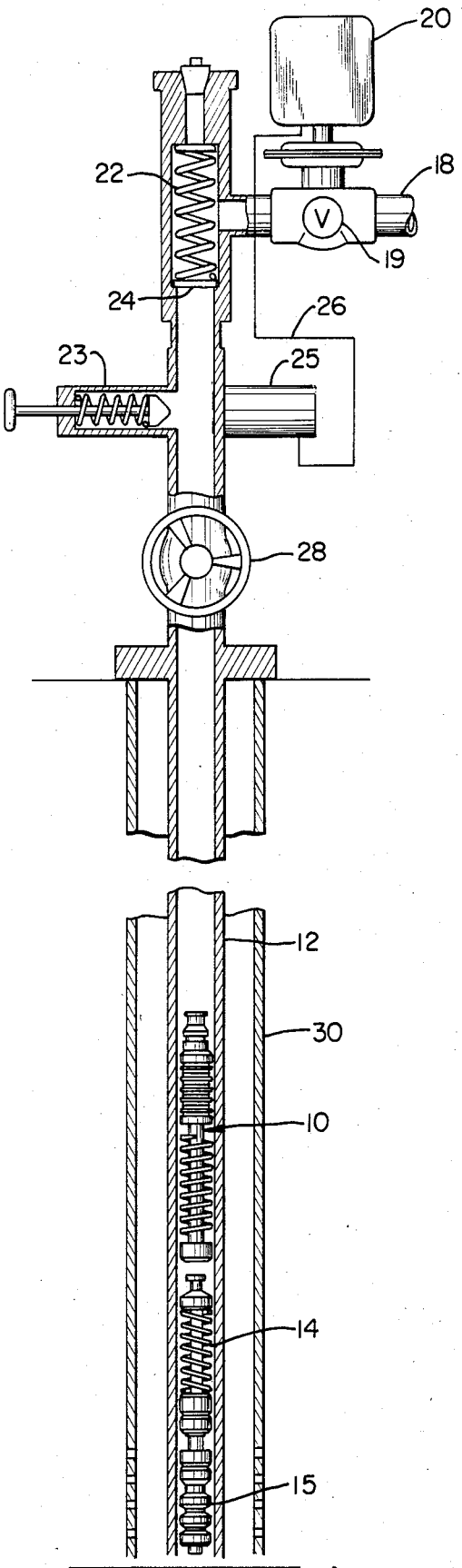
FIG. 1 is a view partially in section of a typical plunger lift installation employing one embodiment of the plunger lift of the present invention.
Figure 2:
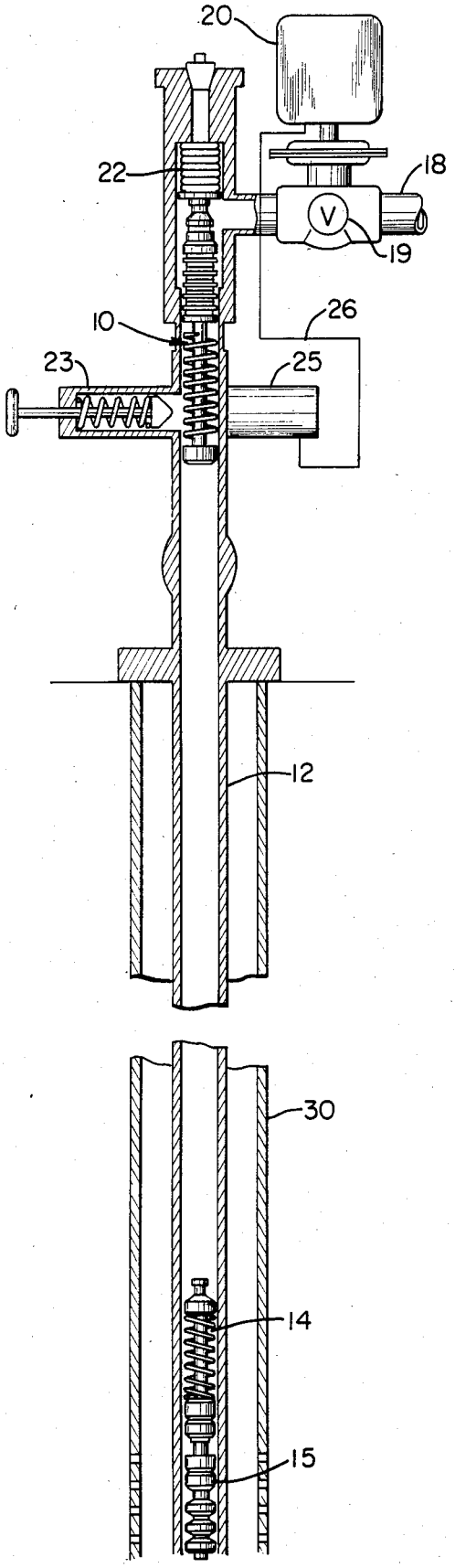
FIG. 2 is a view similar to FIG. 1 and illustrating the plunger lift at the completion of a lift operation.

Referring in detail to the drawings, there is illustrated in FIGS. 1 and 2 a typical plunger lift installation in which the preferred form of plunger 10 of the present invention is disposed in a tubing string 12 for reciprocal or cyclical movement through the tubing string in response to the differential pressure across the plunger. In a typical lift installation, and as a setting for the present invention, the assembly comprises a bumper spring 14 to which is secured a tubing stop 15 at the lower end of travel of the plunger 10 within the tubing string. The tubing string communicates at its upper end with a sales line 18 in which is suitably located a time cycle controller 20 to regulate opening and closing of a valve 19 and to control the cyclical operation of the plunger. An upper, spring-loaded limit stop 22, commonly referred to as a lubricator, is employed in cooperation with a manual catcher 23, the limit stop serving to cushion the shock of the plunger as it approaches the upper end of its travel and having an end plate 24 which seats on the plunger as it surfaces. In turn, the manual catcher 23 permits the operator to hold the plunger in place against the upper limit stop until manually released and is a spring-loaded ball type catcher as shown. In order to sense the upper travel of the plunger as it reaches the end of its cycle, a sensor as represented at 25 electrically senses the passage of the plunger and directs a signal to the time cycle controller 20 via electrical lead 26. In addition, a manual control valve 28 is customarily provided at the upper end of the tubing string and, in a well-known manner, the tubing is mounted in an outer casing 30 for the well. Generally, therefore, in gas wells making water or in high gas/oil ratio wells where the rate of oil or water flow is limited and tends to restrict the flow of gas, the plunger lift will function to retard the passage of oil or water through the tubing string and establish an interface between the fluid and gases as it travels upwardly toward the surface. Only after a predetermined amount of oil or water has accumulated above the plunger will the time cycle controller 20 be activated to open the flow control valve 19 for the sales line to deliver the fluid to a suitable processing or stock tank until the pressure in the tubing string above the plunger is reduced a selected amount. Once reduced, the differential pressure at opposite ends of the plunger will cause the plunger to rise upwardly through the tubing string to lift any oil which has accumulated above it and discharge it through the sales line. The valve 19 in the sales line 18 is closed by the time cycle controller 20, and the plunger 10 will then return downwardly to its lowermost limit in the tubing string in preparation for the next successive cycle.

Figure 4:
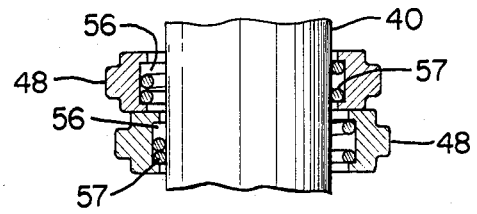
FIG. 4 is an enlarged fragmentary view partially in section of a portion of the seal assembly on the plunger lift shown in FIG. 3.
Figure 3:
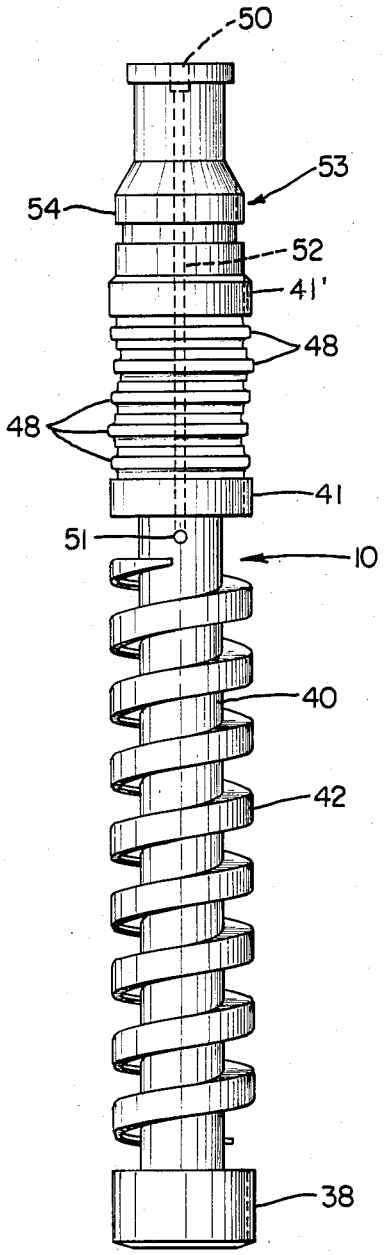
FIG. 3 is a front view in elevation of the plunger lift illustrated in FIG. 1.

Considering in more detail the embodiment of the plunger shown in FIG. 1, as illustrated in detail in FIGS. 3 and 4, the plunger 10 is a one-piece integral unit and is comprised of an enlarged lower end 38, an elongated solid shaft 40 having an external, spiral extending coil 42 disposed in continuous spiral fashion and in fixed relation to the external surface of the shaft 40. The coil 42 can be formed from a single, integral member by machining the member in such a manner that the coil 42 results. The desired difference between the diameter of the shaft 40 and the diameter of the coil 42 is determined by compromising between providing sufficient tool strength by having a large shaft diameter and providing maximized lifting capability by having a large difference between the shaft diameter and coil diameter. The coil 42 is disposed such that an angle of less than 90° is formed by any one of a number of portions of the coil 42 and a line through such a portion and the line also being perpendicular to the longitudinal extent of the shaft 40. To function in wells for which the present invention is most suitable, this angle must be between about 20°–35°. With regard to angles less than about 20° and greater than about 35°, it appears that the plunger lift fails to achieve a proper spinning action and does not satisfactorily perform in the relatively low pressure wells best suited for the present invention.

The coil 42 defines a radially outwardly projecting web 44 terminating in an outer rim 45, the rim 45 being directed downwardly from the web 44 in an axial direction beyond the web 44 so as to form an undercut portion 46 beneath the web 44. The coil 42 traverses the major length of the shaft 40 with the undercut portion defining a continuous passage throughout the length of the coil 42 for advancement of well fluids therealong. The upper end portion of the shaft 40 is separated from the coil section 42 by an enlarged ring or shoulder 41 and is provided with a series of circumferentially extending, annular seals 48. The seals are loosely stacked on the shaft 40 between the shoulder 41 and an upper shoulder 41', the seals projecting radially and outwardly from the shaft and being sized for disposition in substantally sealed relation to the tubing string in a manner to be described. In addition, a choke passage 50 extends from communication with the upper terminal end of the coil 42 through the upper end of the shaft 40 for selective but limited withdrawal of fluids from the upper end of the coil 42 past or through the upper seal members 48. Specifically, the choke passage 50 is in the form of a bore starting at hole 51 provided in the shaft 40 and extending radially through the shaft 40 to communicate with a central bore 52 extending upwardly through the upper end of the shaft 40 including its upper extremity 53. Where there is heavy fluid on the back side of the tubing string; i.e., between the tubing string and casing 30 as the plunger 10 travels over extended distances along the tubing string 12 the choke area effectively establishes a downhole divider from the bottom of the hole to the top instead of providing for a choke only at the wellhead or ground surface. At upper extremity 53, the shaft 40 is provided with a collar 54 to facilitate grasping by any suitable form of retrieval device in removal of the plunger lift from the tubing string for service or repair as desired.

As shown in FIGS. 3 and 4, a particular feature of the upper seal members 48 is that they are preferably in the form of metal washers or rings, commonly termed "wobble washers", each provided with an internal groove 56 in which is positioned a coiled spring 57 having an inner free end bearing against the outer surface of the shaft 40. The wobble washers are free to rotate with respect to one another and with respect to the shaft 40 so as to become offset in different radial directions away from the shaft with each bearing against a different area of the tubing string 12. A series of five washers or seals 48 are illustrated in FIG. 4, but it will be readily appreciated that any number of seals may be positioned on the shaft according to the extent or degree of sealing desired. In this relationship, the washers are intended to prevent gas leakage or escape from the upper terminal end of the coil 42 past the seal member 48.

Figure 6:
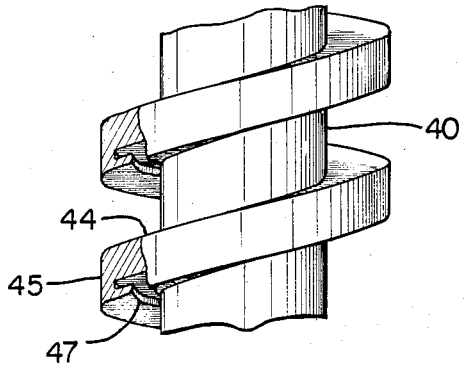
FIG. 6 is an enlarged view of a modified form of the spiral coil of the plunger lift in accordance with the present invention.
Figure 5:
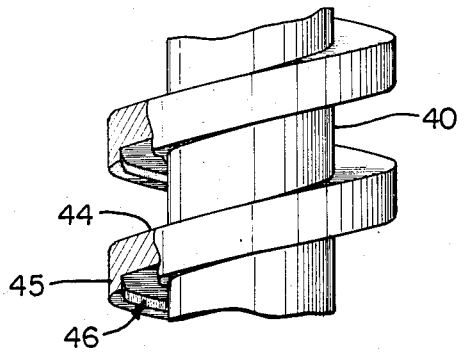
FIG. 5 is an enlarged view in detail partially in section of the lower spin-imparting section of the plunger lift of FIG. 3.

The undercut formed along the bottom surface of the coil 42 may either be a straight undercut or have an inward return or lip 47 as illustrated in the modified form of invention shown in FIG. 6. Most importantly, however, the coil is formed or positioned so that an oblique angle is defined by the coil 42 relative to the shaft 40. This configuration is believed to cause liquid in the well below the plunger 10 to adhere to or contact the shaft 40 as the liquid moves along the coil 42 during the upward movement of the plunger 10. In numerous embodiments of the present invention, the coil 42 extends for the major length of the shaft 40. The coil 42 acts to impart the desired spinning action to the plunger as it advances over extended distances through the tubing string. For instance, in typical applications the plunger may be required to advance for one to one and a half miles in an 8,000 foot well and it is therefore important that sufficient spinning action be imparted to the plunger to obviate possible lodging or jamming within the tubing string which could otherwise result from the movement along the inner surface of the tubing string particularly under low pressure conditions.

As noted earlier, in operation, the plunger establishes an interface between the fluid and gases as it advances upwardly through the tubing string to expel fluid, the plunger movement being the result of cyclical operation which is controlled by opening and closing a motor valve either with a time cycle controller as described or other type of automated pressure actuator controller. The plunger lift itself effects a means of artificial lifting which utilizes the energy existing in the well which could not otherwise be efficiently expelled under natural flow. In this relation, the plunger has numerous applications not only for dewatering gas wells but for high gas/oil ratio wells and for cutting paraffin.

Figure 7:
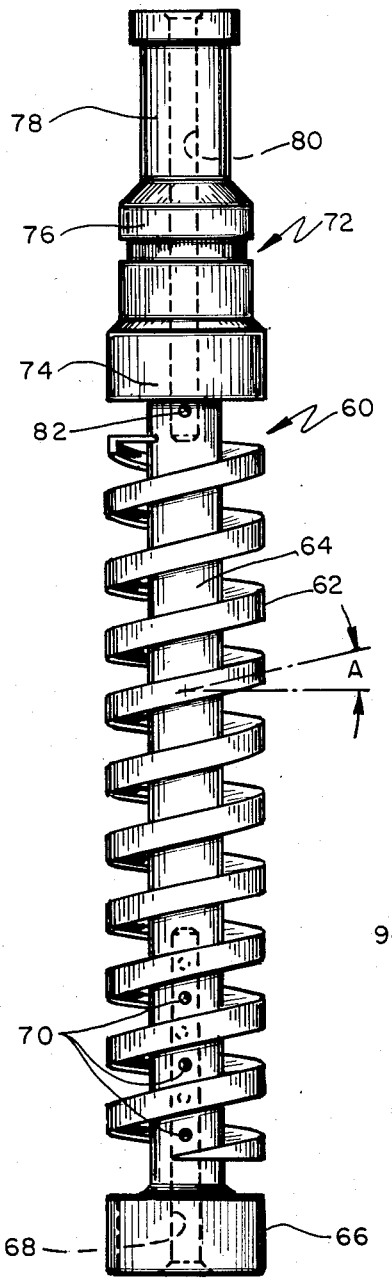
FIG. 7 is a front view in elevation of another embodiment of the plunger lift of the present invention.
Figure 8:
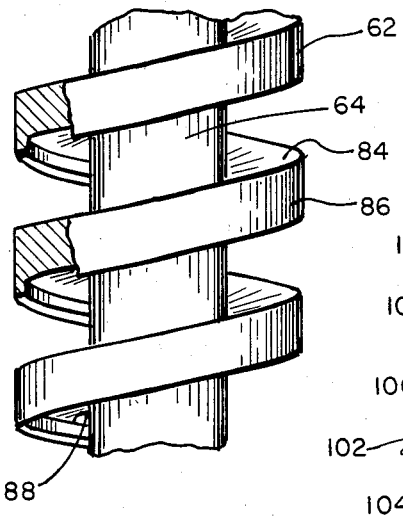
FIG. 8 is an enlarged view in detail partly in section of the lower spin-imparting section of the plunger lift of FIG. 7.

Another embodiment of a plunger lift incorporating the basic features of the present invention is illustrated in FIGS. 7 and 8. The plunger 60 of FIGS. 7 and 8 is also an integral unit having a spiral coil 62 disposed about a shaft 64. Each portion of the coil 62 forms an oblique angle A that is defined by a line perpendicular to the shaft 64 and this line also intersecting such a coil portion. See FIG. 7 illustrating angle A. In virtually all of the desired applications of the present invention, the oblique angle A must be in the range of 20°–35°.

Also part of the integral plunger 60 is a lower end 66 which is generally cylindrical shaped and has a lower bore 68 formed beginning at the bottom face of the lower end 66 and extending therethrough and extending into the shaft 64. The lower bore 68 terminates along the longitudinal extent of the shaft 64. A number of lower holes 70 are formed in the shaft 64 and each communicates with the lower bore 68.

The plunger 60 also includes an upper end 72 which is located at an end of the plunger that is opposite the lower end 66. The upper end 72 includes a flange 74 located immediately adjacent to the shaft 64. The diameter of the flange 74 essentially corresponds to the diameter of the lower end 66. The upper end 72 also has a collar 76 and an upper extremity 78 with the collar 76 being located between the flange 74 and the upper extremity 78. A choke passage is also provided in this embodiment of the present invention. The choke passage includes an upper bore 80 formed through a portion of the shaft 64, and completely through the flange 74, the collar 76, and the upper extremity 78 so that there is fluid communication between the outside face of the upper extremity 78 and the upper portion of the shaft 64. An upper hole 82 is formed in the upper portion of the shaft 64 to permit fluid communication into the upper bore 80.

As seen in FIG. 8, the coil 62 is defined by a radially outwardly projecting web 84 terminating in an outer face or rim 86. The rim 86 is directed downwardly from the web 84 in an axial direction beyond the web 84 so as to form an undercut portion 88 beneath the web 84. The undercut portion 88 provides a continuous passage throughout the length of the coil 62 for advancement of fluids therealong.

In operation, as with the embodiment of FIG. 3, the plunger 60 is able to bring about its own lifting using a pressure differential between the upper end 72 and the lower end 66 of the plunger 60. It has been observed during simulated operation that, as the plunger 60 moves upwardly, liquid contacts and essentially adheres to the shaft 64 as it moves along the underside of the spiral coil 62 from the lower portions of the coil 62 to its upper portions. In connection with initially starting the spinning motion of the plunger 60, liquid enters the lower bore 68 and exits the lower holes 70 formed in the shaft 64 to assist in causing the initial movement of the plunger 60 due to the liquid exiting the holes 70 and contacting the underside of the spiral coil 62. After the plunger 60 has begun to spin, very little, if any, liquid enters the lower bore 68. To further facilitate upward movement, as well as the downward descent, of the plunger 60, a limited amount of fluid reaching the upper portion of the shaft 64 is able to exit past the flange 74 using the upper hole 82 formed in the shaft 64 and using the upper bore 80 formed in the upper end 72.

Figure 10:
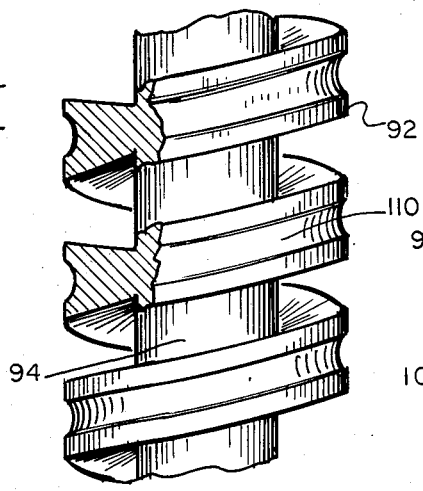
FIG. 10 is an enlarged view in detail partially in section of the lower spin-imparting section of the plunger lift of FIG. 9.
Figure 9:
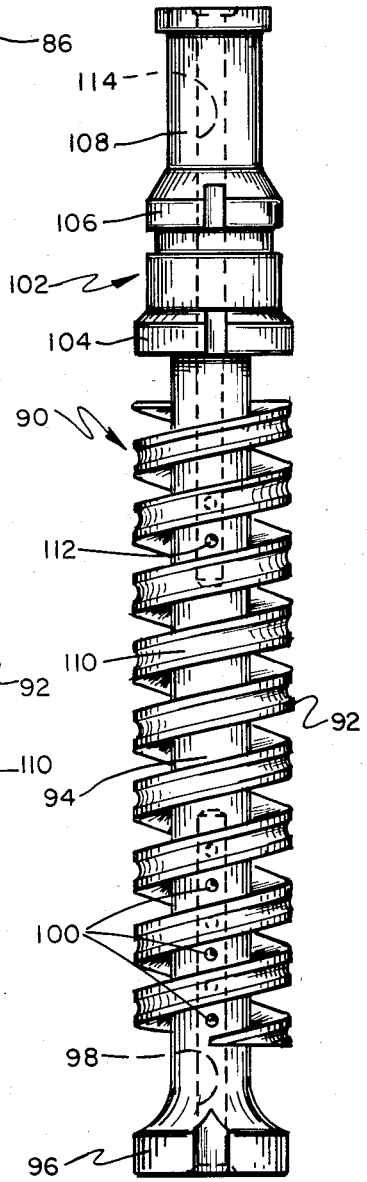
FIG. 9 is a front view in elevation of still another embodiment of plunger lift of the present invention.

A further embodiment of the present invention is shown in FIGS. 9 and 10. Like the other embodiments, the plunger 90 is an integral, one-piece unit that is caused to rotate using a spiral coil 92 disposed along a shaft 94. Portions of the spiral coil 92 together with lines perpendicular to the longitudinal extent of the shaft 94 and through such portions, form oblique angles. As with the other embodiments, in essentially all applications best suited for this invention, this angle must be in the range of 20°–35°.

The plunger 90 also has a lower end 96 and a lower bore 98 formed through the lower end 96 and which extends some distance into the shaft 94. The lower bore 98 communicates with a number of lower holes 100 to provide the same initial starting action as is available in the plunger of FIG. 7. The plunger 90 also has an upper end 102 that is integral with the shaft 94 and includes a flange 104, a collar 106, and an upper extremity 108, similar to the embodiment of FIG. 7. Similar to the embodiment of FIG. 7, the flange 104 and collar 106 are used to facilitate removal of the plunger 90 from the tubing string 12.

This embodiment is characterized by a novel shape of the individual coils of the spiral coil 92. In particular, a groove 110 is formed in the outer face or rim of the spiral coil 92. Additionally, the upper surface or face of the coil 92, as well as the underside thereof, is wave-shaped wherein the thickness of the spiral coil 92 near the outer edge or rim of the spiral coil 92 is greater than the thickness of portions of the spiral coil 92 that are adjacent to the shaft 94. This is best seen in FIG. 10. Another modification in this embodiment is the location of an upper hole 112. Rather than being located above all of the coils of the spiral coil 92 and adjacent to the first collar 102, the upper hole 112 is provided between portions or coils of the spiral coil 92. Like the other embodiments, the upper hole 112 communicates with an upper bore 114 that extends through the upper end 102 and into the shaft 94 for communication with the upper hole 112.

This configuration of a plunger, including the channels 110 formed in the spiral coil 92 and the reduced thickness of the coil 92 adjacent to the shaft 94, significantly reduces the weight of the plunger 90 to facilitate the lifting thereof during its operation in a well bore. In addition, it is believed that the channels 108 facilitate the initial spinning of the plunger 90 from its lowermost location in the well. Once the initial lifting has taken place and gas pockets are formed on either side of the plunger 90, the liquid no longer contacts channels 110 but instead essentially contacts and adheres to the shaft 94. It is believed that this particular embodiment is most useful in wells having liquid to a great depth.

Each of the embodiments of the present invention has been found to be especially useful as means of artificial lift in low pressure gas/oil ratio wells where for example the gas flow is as low as 40 mcfs against 60 psi pressure by virtue of the spinning action established along the substantial length of the lift coupled with the controlled leakage of fluid through the upper end of the plunger shaft as described. Thus for example in gas/oil wells, as the oil accumulates in the tubing string and restricts the movement of gas through the well, the oil will nevertheless eventually advance past the plunger through the choke and loosely fitting seal or flange area. The time cycle controller is set in accordance with conventional practice to afford sufficient time for accumulation of the oil at which point the normally closed valve 19 is opened to permit the flow of oil through the sales line 18 to a suitable stock tank thereby reducing the pressure in the tubing string above the plunger and increasing the differential pressure and cause the plunger to initiate its upward movement through the tubing string. In this manner the plunger will continue to lift or force any oil which has accumulated above the plunger and drive it through the sales line so long as the valve 19 remains open. Generally, closing of the valve is initiated by advancement of the plunger past the sensor 25, whereupon closing of the valve 19, the plunger will by virtue of the reduced pressure beneath it return to its initial position at the lower end of the tubing string. The selective leakage of fluids through the upper portion of the plunger is believed to accelerate the movement of the plunger both in lifting and return to its initial position. Further as noted the spinning action of the plunger not only contributes to the accelerated movement of the plunger throughout the tubing string but minimizes any lodging or jamming.

Therefore, while a number of embodiments of the present invention have been set forth herein, it is to be understood that further various modifications and changes may be resorted to without departing from the spirit and scope of the present invention as defined by the appended claims.

What is claimed is:

1. A plunger lift apparatus disposed in a well for slidable movement in response to variations in pressure, said apparatus comprising:

an integral, one-piece unit including a lower end portion, and a generally cylindrical, elongated shaft extending from said lower end portion and of a length which substantially defines the longitudinal extent of said apparatus, said shaft having an external, continuous and spirally extending coil integrally formed therewith, said spiral coil having an underside portion, said spiral coil being defined by at least one complete and continuous 360° revolution which extends about and along said shaft for a majority of said length of said shaft, and said spiral coil and a line perpendicular to the longitudinal extent of said shaft defining an oblique angle, wherein liquid located in the well, in response to pressure changes, moves upward along substantially the entire longitudinal extent of said underside portion of said spiral coil thereby imparting hydraulic forces to said spiral coil resulting in a rotational and upward movement of the entire apparatus.

2. An apparatus, as claimed in claim 1, wherein:

said angle being defined by said spiral coil and said line perpendicular to the longitudinal extent of said shaft is in the range of about 20°–35°.

3. An apparatus, as claimed in claim 1, further including:

choke passage means including a hole formed in said shaft to receive fluid passing from portions of said spiral coil.

4. An apparatus, as claimed in claim 1, further including:

a flow passage formed through a bottom surface of said lower end portion and at least a portion of said shaft to which portions of said spiral coil are affixed, said flow passage being in communication with the outer surface of said shaft so that liquid is able to pass upwardly and exit outwardly of said shaft.

5. An apparatus, as claimed in claim 1, wherein:

said spiral coil includes an outer rim with a channel formed in said outer rim.

6. An apparatus, as claimed in claim 1, wherein:

portions of said spiral coil adjacent to an outer rim thereof being thicker than portions of said spiral coil located adjacent to said shaft.

7. An apparatus, as claimed in claim 1, further including:

an upper end portion integrally connected to said shaft to facilitate removal of the apparatus from the well.

8. An apparatus, as claimed in claim 1, wherein:

said spiral coil is defined by a web projecting radially and outwardly from said shaft and terminating in an outer rim, said outer rim directed downwardly in an axial direction away from said web to form an undercut portion beneath said web for the advancement of liquid therealong.

9. An apparatus, as claimed in claim 1, wherein:

said spiral coil includes an outer rim having a lower edge and said outer rim terminates at its lower edge in a radially inwardly directed lip extending the substantial length of said coil.

10. An apparatus, as claimed in claim 1, wherein:

said spiral coil constitutes at least one-half of the longitudinal extent of the apparatus.

11. A method for removing liquid located in a tubing string, comprising:

providing an integral, one-piece plunger including an upper end, a lower end, and a generally cylindrical, elongated shaft of a length which substantially defines the longitudinal extent of said plunger;

forming a spiral coil about said shaft, said sprial coil having an underside and including at least one continuous coil extending about said shaft for at least one 360° revolution and along said shaft for a majority of said length of said shaft, said spiral coil and a line perpendicular to the longitudinal extent of said shaft defining an oblique angle;

positioning said plunger in the tubing string;

causing liquid to continuously follow substantially the entire longitudinal extent of the underside of said spiral coil;

using the movement of the liquid along the underside of said spiral coil to spin the plunger; and carrying the plunger upward using the spinning action of the plunger.

12. In a method, as claimed in claim 11, further including the step of:

permitting liquid to enter said lower end of said shaft and escape outwardly of said shaft to contact said spiral coil.

13. In a method, as claimed in claim 11, further including the step of:

permitting liquid to enter into said shaft at said upper end thereof.

14. In a method, as claimed in claim 11, wherein:

said step of forming a spiral coil includes forming said spiral coil in which the oblique angle formed is between about 20°–35°.

* * * * *